US007004456B2

(12) United States Patent
Newman

(10) Patent No.: US 7,004,456 B2
(45) **Date of Patent: *Feb. 28, 2006**

(54) ENGINE SPEED LIMITER FOR A HOIST

(75) Inventor: Frederic M. Newman, Midland, TX (US)

(73) Assignee: Key Energy Services, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/263,630

(22) Filed: Oct. 3, 2002

(65) Prior Publication Data

US 2004/0065874 A1 Apr. 8, 2004

(51) Int. Cl.
*B66D 1/00* (2006.01)

(52) U.S. Cl. ..... 254/323; 254/267; 166/77.51

(58) Field of Classification Search ..... 254/267, 254/269, 274–276, 323, 326, 328, 360, 282, 254/350; 166/53, 77.51
See application file for complete search history.

(56) References Cited

U.S. PATENT DOCUMENTS 3,967,175 A * 6/1976 Turley ..... 318/258
4,012,677 A * 3/1977 Rist et al. ..... 318/149
4,017,739 A * 4/1977 Hapeman et al. ..... 290/14
4,324,387 A 4/1982 Steinhagen ..... 254/310
4,434,971 A 3/1984 Cordrey
4,624,450 A 11/1986 Christison
5,039,028 A 8/1991 Svedlund et al.
5,284,325 A * 2/1994 Sasaki et al. ..... 254/274
5,292,108 A * 3/1994 Sutton ..... 254/323
5,390,747 A 2/1995 Gu et al. ..... 173/4
5,662,311 A 9/1997 Waedekin et al.
5,692,733 A * 12/1997 Hiramatsu ..... 254/274
5,692,735 A * 12/1997 Aho et al. ..... 254/323
5,713,422 A 2/1998 Dhindsa
5,794,920 A * 8/1998 Kronberger ..... 254/361
6,079,490 A 6/2000 Newman ..... 166/77.51
6,209,639 B1 4/2001 Newman ..... 166/250.01
6,212,763 B1 4/2001 Newman ..... 29/702
6,213,207 B1 4/2001 Newman ..... 166/250.01
6,241,020 B1 6/2001 Newman ..... 166/250.01
6,253,849 B1 7/2001 Newman ..... 166/255.1
6,276,449 B1 8/2001 Newman
6,374,706 B1 4/2002 Newman ..... 81/57.34
6,377,189 B1 4/2002 Newman ..... 340/854.6
6,644,629 B1 * 11/2003 Higashi et al. ..... 254/361

* cited by examiner

*Primary Examiner*—Emmanuel Marcelo
(74) *Attorney, Agent, or Firm*—King & Spalding, LLP

(57) ABSTRACT

A mobile service rig for wells includes a hoist powered by an internal combustion engine. In response to the hoist exerting a predetermined lifting force, the lifting force is limited by automatically limiting or reducing the speed of the engine.

18 Claims, 3 Drawing Sheets

ENGINE SPEED LIMITER FOR A HOIST

BACKGROUND OF THE INVENTION

1. Field of the Invention

The subject invention generally pertains to mobile service rigs for wells and more specifically to a mobile service rig that includes an engine powering a hoist.

2. Description of Related Art

Oil wells and wells for other fluids typically include a well casing, tubing, sucker rods and a reciprocating drive unit. A well casing is what lines the well bore and usually comprises a long string of relatively large diameter pipe interconnected by threaded couplings known as collars. Casings generally define the overall diameter and depth of a well bore. Well tubing typically comprises a long string of pipe sections whose threaded ends are also interconnected by threaded couplings. The tubing extends down through the casing and provides a conduit for conveying oil or some other fluid to the surface of the well. A submerged reciprocating pump attached to the lower end of the tubing draws the fluid from the annulus between the inside diameter of the casing and the outside diameter of the tubing, and forces the fluid up through the tubing to the surface. To operate the pump, a string of sucker rods extends through the tubing to serve as a long reciprocating connecting rod that couples the submerged pump to a reciprocating drive unit at ground level. A string of sucker rods typically includes numerous sucker rods whose ends are interconnected by a threaded rod coupling.

Wells periodically need servicing or repair. Servicing wells or drilling new ones can involve a variety of tasks that include, but are not limited to, installing or removing sections of casing, sucker rods, tubing and pumps. Such tasks are typically done using a mobile service rig, which is a truck that includes a hoist for lifting the various well components. The hoist is usually powered by a diesel engine whose speed helps determine how much power is delivered to the hoist. An operator can manually adjust the engine's speed to meet the lifting requirements of a particular job. For handling casings and other heavy loads, the engine may be run at full speed. The engine's speed may be decreased for lighter loads, such as sucker rods.

Except for some technical guidance that may be provided by the operator's supervisor, the speed of the engine or the amount of power delivered to the hoist is often left to the operator's discretion. As a result, accidents may occur when excessive power is delivered to a load. Not only can various well components be broken, but also the hoist itself can be damaged. For instance, if a transmission coupling the engine to the hoist is placed in its lowest gear while the engine is run at full speed, a tremendous amount of lifting force can be developed. Such force may exceed the rated capacity of one or more hoist components, such as the hoist's derrick, cable, or drawworks (i.e., powered drum that draws in and pays out the cable). Exceeding the rated capacity of the hoist can lead to catastrophic results.

Consequently, there is a need for a more failsafe system for ensuring that predetermined hook loads are not exceeded.

SUMMARY OF THE INVENTION

To avoid applying excessive lifting force, it is an object of the invention to at least limit the speed of a hoist's engine in response to sensing that a predetermined lifting force has been reached.

Another object of some embodiments is to reduce the hoist's engine speed in response to sensing that the predetermined lifting force has been reached.

Another object of some embodiments is to reduce the speed of the hoist's engine by exhausting pressurized air to atmosphere.

Another object of some embodiments where the speed of an engine can be manually varied from two locations, is to automatically limit or reduce the engine's speed from a third location.

Another object of some embodiments is to limit or reduce an engine's speed by simply actuating a solenoid valve.

Another object of some embodiments is to limit or reduce an engine's speed in response to sensing the pressure in one or more pads that are pressurized by the weight of a hoist derrick.

Another object of some embodiments is to detect the failure of one of two pads by detecting that their cumulative pressure is below a certain level.

Another object of some embodiments is to use a strain gage to sense the load on a hoist.

Another object of some embodiments is to use a torque converter to couple the engine to a transmission.

Another object of some embodiments is to use the engine to selectively power a hoist and the movement of a truck that carries the hoist.

Another object of some embodiments is to periodically zero a load-sensing system.

Another object of some embodiments is to limit or reduce the lifting force of a hoist by limiting or reducing an engine's rate of fuel consumption.

One or more of these and other objects of the invention are provided by a mobile service rig that includes an engine-powered hoist. The lifting force of the hoist is limited or reduced in response to reaching a predetermined lifting force. The lifting force can be limited or reduced by limiting or reducing the speed of the engine.

DESCRIPTION OF THE PREFERRED EMBODIMENT

When operating a hoist of a mobile service rig, accidents can be avoided by limiting the hoist's engine speed in response sensing that the hook load of the hoist has reached a predetermined limit.

Figure 1:
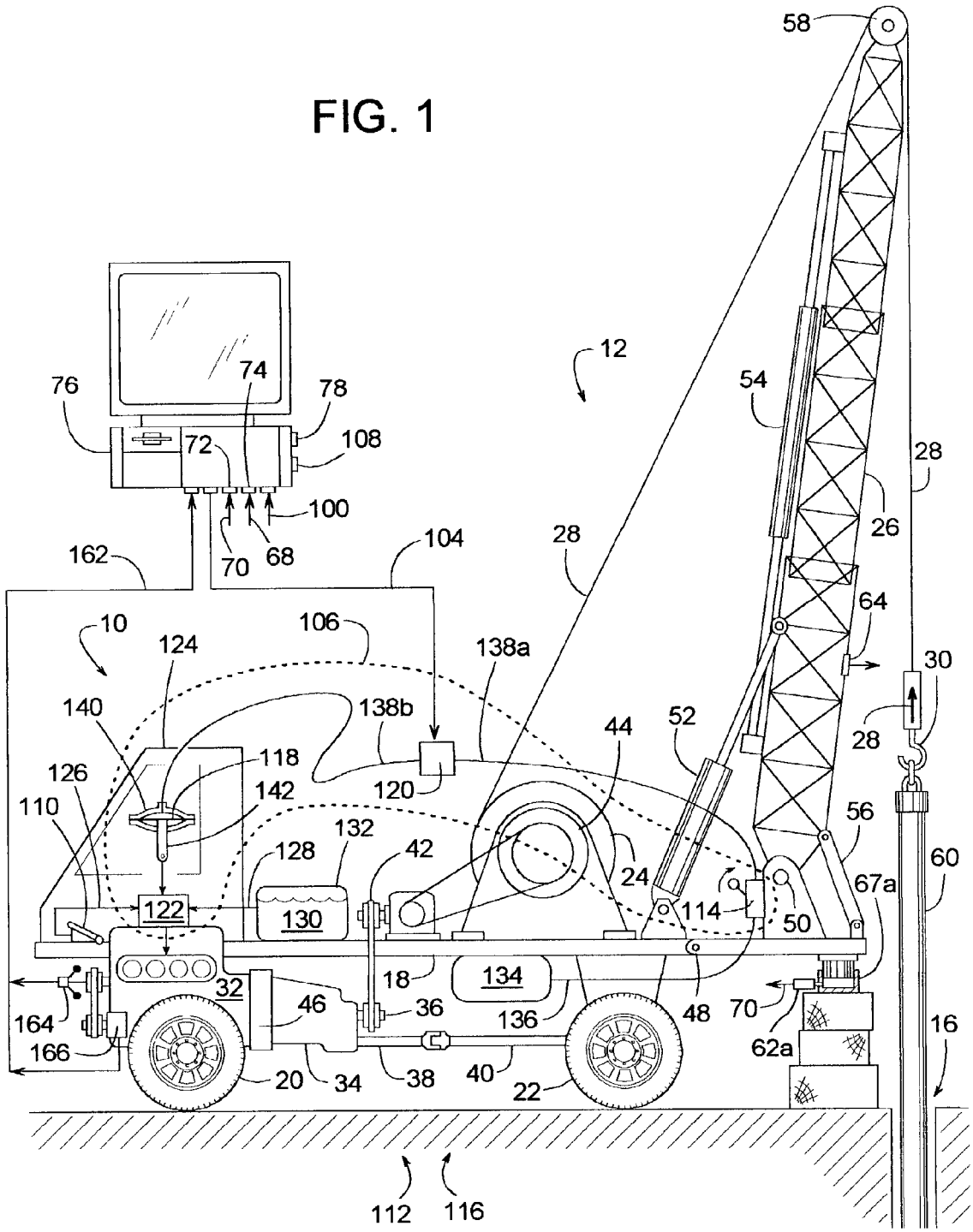
FIG. 1 is a schematic view of a mobile service rig according to at least one embodiment of the invention.

One example of a mobile service rig 10 with a hoist 12 for exerting an upward force 14 that varies while servicing a well 16 is schematically illustrated in FIG. 1. In this example, service rig 10 is a vehicle that includes a truck frame 18, a drive wheel 20 and/or 22 coupled to frame 18 for propelling rig 10 along a road, a hoist drum 24 supported by frame 18, a derrick 26 coupled to frame 18, a hoist cable 28 supported by derrick 26 and spooled about drum 24, a block 30 suspended from cable 28 (block 30 can be a hook or some other device that transmits force 14 to cable 28), an internal combustion engine 32 supported by frame 18, and a transmission 34 that couples engine 32 to hoist drum 24 and drive wheel 22.

To drive either hoist drum 24 or drive wheel 22, transmission 34 can be a General Motors or Allison transmission that includes two output shafts 36 and 38. A drive shaft 40 can couple output shaft 38 to drive wheel 22, and a drive train 42 can couple output shaft 36 to hoist drum 24. A clutch 44 can be used to selectively engage or disengage drive train 42 to hoist cable 28. A torque converter 46 can be used to couple engine 32 to transmission 34, wherein the term, "torque converter" broadly refers to any fluidic apparatus able to couple the rotation of one element to another while allowing some rotational slip between the two elements (e.g., between the engine's output shaft and the transmission's input shaft). The slip provided by torque converter 46 allows transmission 34 to respond to an increase in load (hoist load or vehicle transport load) by delivering greater torque upon the transmission's output speed being reduced by the increased load.

Derrick 26 can be pivotally coupled to frame 18 through pivotal connection 48 and/or 50, which allows a cylinder 52 to pivot derrick 26 between a raised position, as shown in FIG. 1, and a laid-down, stored position for transport. Also, a double-ended cylinder 54 can extend and retract derrick 26 in a telescoping manner between the derrick's extended configuration of FIG. 1 and its retracted configuration for transport. A disconnectable brace 56 can be used to help hold derrick 26 at its raised position. Consequently, derrick 26 is pivotally mounted to frame 18, yet brace 56 and/or cylinder 52 can temporarily hold derrick 26 at a generally fixed orientation when necessary. Derrick 26 includes an upper pulley 58 that helps support and guide hoist cable 28. So, hoist drum 24 selectively drawing in and paying out cable 28 respectively raises and lowers block 30.

Force 28 is created by applying or suspending a load 60 from block 30. Load 60 is schematically illustrated to represent various items that the hoist may carry, such as sucker rods, tubing, casings, etc. In addition to the weight of load 60, other factors can contribute to the value of force 28. These other factors may include vertical acceleration of load 60, friction between load 60 and the well bore, and fluidic drag between load 60 and fluids in the well. Often, increasing the speed of lifting load 60 can increase force 28, especially in the case of fluidic drag.

To determine or sense the value of force 28, service rig 10 can be provided with a load sensor, such as a pressure transducer 62*a*, a strain gage 64, or any other device that can provide a load signal that varies in response to force 28 varying. Strain gage 64 can be attached to derrick 60 or to any other part of rig 10 that experiences a physical change due to load 60. For example, in some cases, a load sensor is attached to a guy wire that helps support derrick 26. In other cases, one or more conventional pressure transducers 62*a* and 62*b* can be attached to one or more hydraulic pads 67*a* and 67*b* that help support the weight of derrick 26 and load 60. Pads 67*a* and 67*b* can be a piston/cylinder or a bladder filled with hydraulic fluid. Compressing pads 67*a* and 67*b* increases the hydraulic pressure inside. Pressure sensors 62*a* and 62*b* can then sense that pressure to help determine the compressive force applied to the pads.

Figure 2:
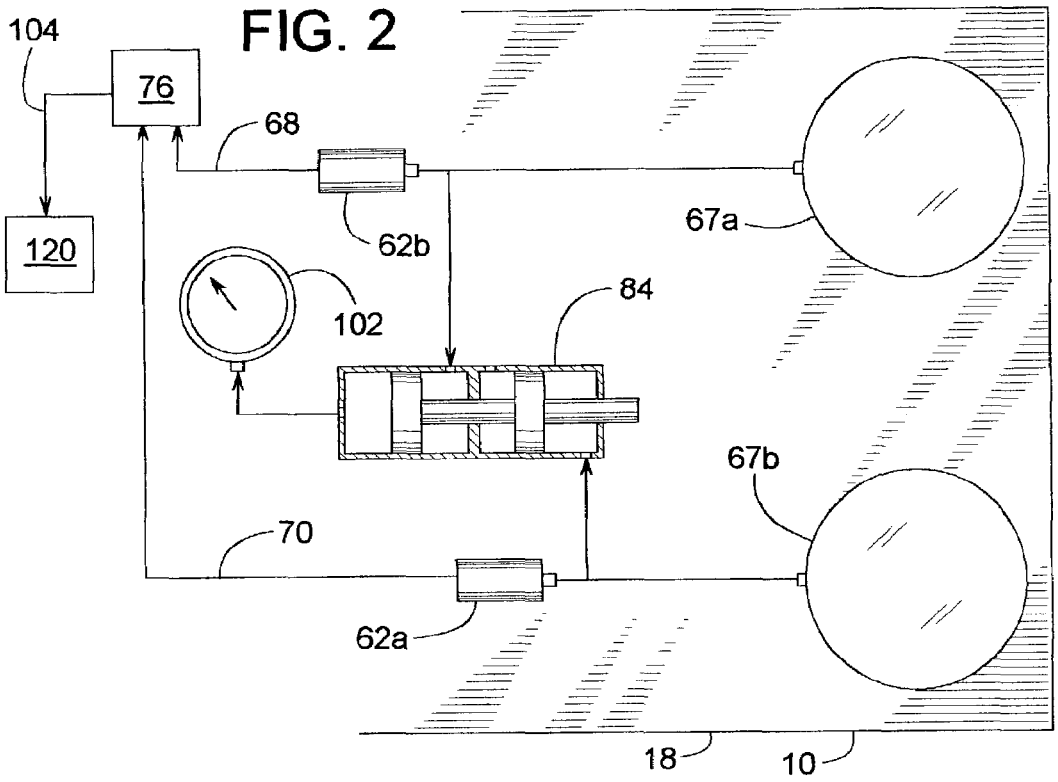
FIG. 2 is a bottom view of a load-sensing hydraulic pad system that supports a rear underside portion of the service rig.
Figure 3:
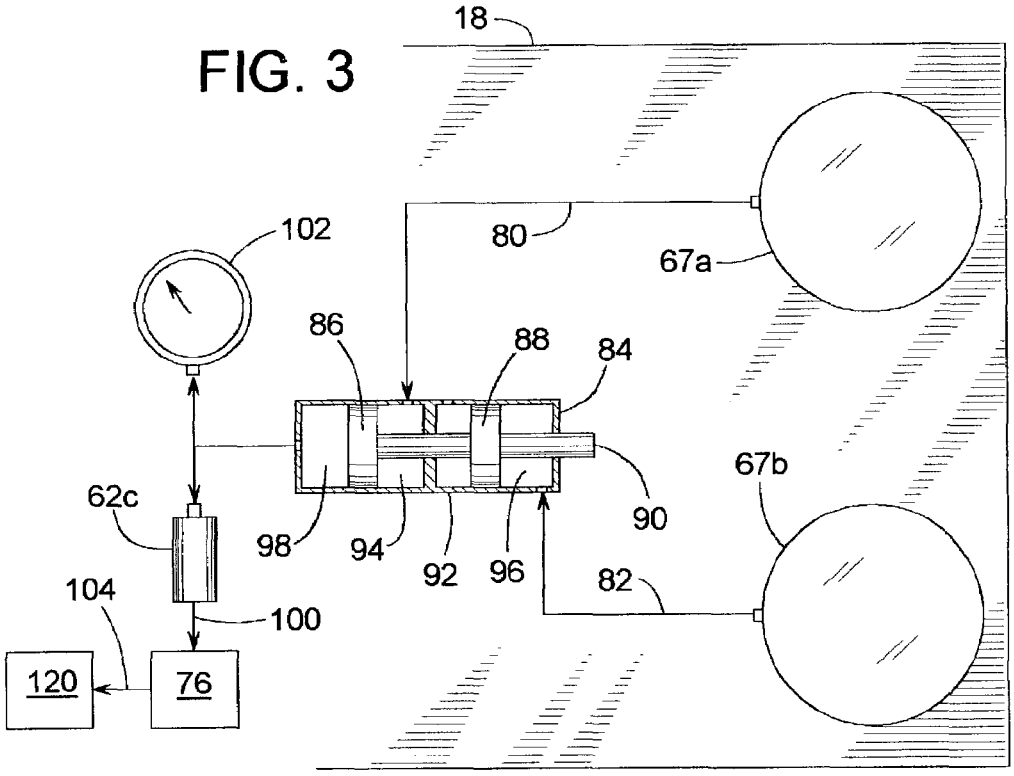
FIG. 3 is similar to FIG. 2, but of an alternate embodiment.

Referring to FIGS. 2 and 3, which are bottom views of pads 67*a* and 67*b* supporting the underside of service rig 10, pressure transducers 62*a* and 62*b* can be connected to pads 67*a* and 67*b* in various ways. In FIG. 2, for example, each pad 67*a* and 67*b* has its own respective pressure transducer 62*a* and 62*b* that provide load signals 68 and 70 whose values vary with the pressure inside the pads. Signals 68 and 70 can be conveyed to inputs 72 and 74 of a controller 76. Controller 76 then calculates force 28 as the sum of signals 68 and 70 when block 30 is carrying load 60 (total-load value) minus the sum of signals 68 and 70 when block 30 is unloaded (zero-load value). An operator can use a pushbutton switch 78 or some other conventional input device to periodically trigger controller 76 to sample the zero-load value. On a more frequent or continuous basis, controller 76 automatically determines the total-load value for calculating force 28. Controller 76 is schematically illustrated to represent any device adapted to provide an output in response to receiving an input that varies with force 28. Examples of controller 76 include, but are not limited to a personal computer; PC; desktop computer; laptop computer; notebook computer; handheld computer; portable computer; microcomputer; microprocessor; PLC (programmable logic controller); integrated circuits; circuits comprising relays, analog components, and/or digital components; and various combinations thereof.

For the example shown in FIG. 3, hydraulic lines 80 and 82 connect pads 67*a* and 67*b* to an integrator 84, such as one provided by the M. D. Totco Company of Cedar Park, Tex. Integrator 84 includes two pistons 86 and 88 that are fixed to a common shaft 90 inside a housing 92 to define two inlet chambers 94 and 96 and an output chamber 98. Line 80 conveys the pressure of pad 67*a* to chamber 94, and line 82 conveys the pressure of the pad 67*b* to chamber 96. The rod side of pistons 86 and 88 each has a pressure-exposed area that is half the full-face area of piston 86. Thus, outlet chamber 98 develops a pressure that is an average of the pressures in pads 67*a* and 67*b*. A transducer 62*c* can be connected to sense the hydraulic pressure in chamber 98 to provide a signal 100 to controller 76, wherein the value of signal 100 varies with the value of force 28. For the embodiments of FIGS. 2 and 3, a pressure gage 102 can be used to sense the pressure in chamber 98 for an indication of force 4. The pressure gage may include a manually rotatable reference member that allows an operator to "zero the gage" by rotating, for example, the face so the gage reads zero pounds when hoist 12 is unloaded.

Regardless of how force 28 is sensed or determined, controller 76 includes an output 104 responsive to a load signal that varies with that force, i.e., load signals such as signals 68, 70, and/or 100. For simplicity, the operation of controller 76 will be described with reference to the system shown in FIG. 3; however, it should be clear to those skilled in the art that the system shown in FIG. 2 and other load-sensing systems are also well within the scope of the invention.

For the system of FIG. 3, output signal 104 commands an engine speed adjuster 106 (FIG. 1) to limit or reduce the speed of engine 32 in response to load signal 100 reaching a predetermined limit. The limit can be a permanent, fixed value, or the limit can be adjustable and manually inputted into controller 76 by way of a conventional input device 108, such as a keyboard, dial, or mouse-click selectable value chosen from a computer's monitor. An adjustable predetermined limit allows one limit to be used for heavy lifting and a lower limit when lifting weaker parts such as sucker rods, which cannot withstand as much lifting force as heavier parts such as casings. Before explaining how output 100 can affect the speed of engine 32, the structure and overall operation of speed adjuster 106 will first be explained.

In some embodiments, engine speed adjuster 106 comprises a first manual actuator 110 at a forward portion 112 of the vehicle, a second manual actuator 114 at a rear portion 116 of the vehicle, a diaphragm 118, and a valve system 120. The term, "forward portion" refers to any part of rig 10 that is closer to the most forward wheel 20 of rig 10, and the term "rearward portion" refers to any part of rig 10 that is closer to the most rearward wheel 22 of rig 10. Also, in some embodiments, engine 32 is a diesel engine that includes a fuel intake system 122, such as a conventional carburetor or fuel injection system. To vary the traveling speed of service rig 10, a driver in cab 124 of rig 10 depresses a foot pedal (also known as a gas pedal or accelerator), which is the most common form of first manual actuator 110. A linkage 126 relays the movement of first manual actuator 110 to fuel intake system 122 in a conventional manner that adjusts the engine's rate of fuel consumption, and thus adjusts the engine's speed and the rig's traveling speed. A fuel line 128 conveys fuel 130 to fuel intake system 122 from a fuel tank 132.

Second manual actuator 114 enables an operator to adjust the speed of the hoist from the rear portion 116 of rig 10. Manual actuator 114 is schematically illustrated to represent any device that can be manually manipulated to vary the speed of engine 32. Some examples of actuator 114 include, but are not limited to an air pressure regulator, a CONTROLAIR or a FLEXAIR. CONTROLAIR and FLEXIAR which may be available through the Rexroth Corporation of Lexington, Ky.

In some embodiments, an air compressor 134 supplies pressurized air (e.g., 125 psi) to actuator 114 via an air line 136. From there, actuator 114 delivers the air to another air line 138 at a pressure that can be adjusted by manual manipulation of actuator 114. From line 138*a*, the pressurized air passes through valve system 120, through an air line 138*b*, and onto a throttle actuator 140. Throttle actuator 140 includes diaphragm 118 that converts the pressure in line 138*b* to a corresponding displacement of a linkage 142. Linkage 142 is coupled to fuel intake system 122, such that the movement of linkage 142 adjusts the engine's fuel consumption, which varies the engine's speed, thereby varying the rotational speed of hoist drum 24. Throttle actuator 118 is schematically illustrated to represent any device that enables manual actuator 114 to adjust the fuel consumption of engine 32. One example of throttle actuator 140 is an A-2-H ACTUATOR POSITIONER, which is a product of the Wabco Fluid Power. Linkage 142 can be arranged such that the speed of engine 32 and hoist drum 24 increases with the pressure in line 138*b*.

To enable speed adjuster 106 to affect the speed of engine 32 in response to output 104, valve system 120 of speed adjuster 106 may assume any one of a myriad of configurations. Some examples of valve system 120 include, but are not limited to, those shown in FIGS. 4*a*, 4*b*, 5*a*, 5*b*, 6*a*, 6*b*, 7*a*, and 7*b*.

Figure 4A:
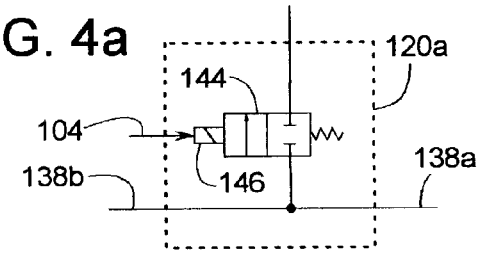
FIG. 4*a* is a schematic view of a valve system in a normal position.
Figure 4B:
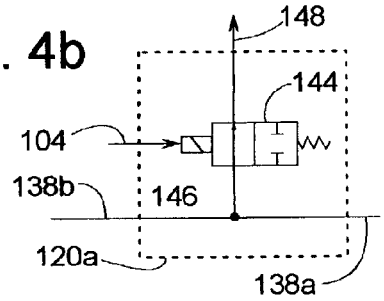
FIG. 4*b* is the same as FIG. 4*a*, but with the valve system in a speed-limiting position.

In FIGS. 4*a* and 4*b*, valve system 120*a* comprises a two-way, two-position, normally-closed, solenoid-operated, spring-return valve 144. In FIG. 4*a*, valve system 120*a* is shown normally closed in its normal position, and in FIG. 4*b* is shown open in its speed-limiting position. Signal 104 acts upon a solenoid 146 to shift valve 144 between its normal and speed-limiting positions. In the normal position of FIG. 4*a*, line 138*a* feeds line 138*b* with pressurized air with generally no interference from valve 144. However, when force 28 increases to a predetermined limit, control 76 provides signal 104 such that signal 104 acts upon solenoid 146 to open valve 144. When valve 144 opens, as shown in FIG. 4*b*, it exhausts pressurized air from lines 138*a* and 138*b* to atmosphere as indicated by arrow 148. Releasing the air pressure in line 138*b* causes throttle actuator 140 to decrease the speed of engine 32 and thus decrease the speed of the hoist.

Figure 5A:
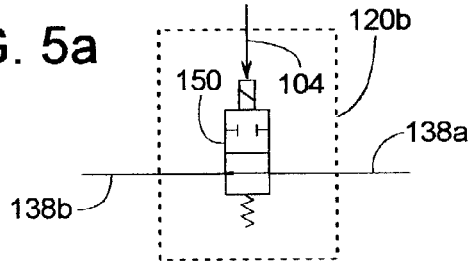
FIG. 5*a* is a schematic view of another valve system in a normal position.
Figure 5B:
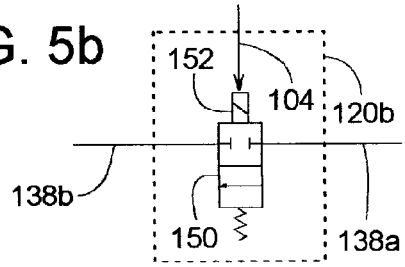
FIG. 5*b* is the same as FIG. 5*a*, but with the valve system in a speed-limiting position.

In FIGS. 5*a* and 5*b*, valve system 120*b* comprises a two-way, two-position, normally-open, solenoid-operated, spring-return valve 150. In FIG. 5*a*, valve system 120*b* is shown normally open in its normal position, and in FIG. 5*b* is shown closed in its speed-limiting position. Signal 104 acts upon a solenoid 152 to shift valve 150 between its normal and speed-limiting positions. In the normal position of FIG. 5*a*, valve 150 allows line 138*a* to feed pressurized air to line 138*b*. However, when force 28 increases to a predetermined limit, control 76 provides signal 104 such that signal 104 acts upon solenoid 152 to close valve 150. When valve 150 closes, as shown in FIG. 5*b*, it prevents pressurized air in line 138*a* from reaching line 138*b*. This limits the pressure on diaphragm 118, which limits the speed of engine 32 and hoist drum 24.

Figure 6A:
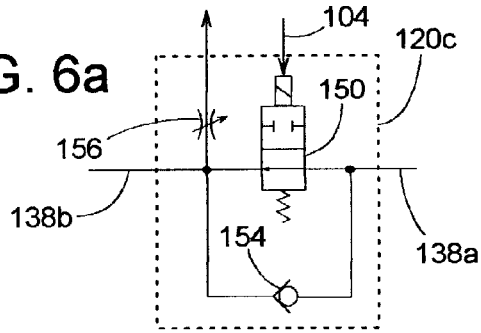
FIG. 6*a* is a schematic view of another valve system in a normal position.
Figure 6B:
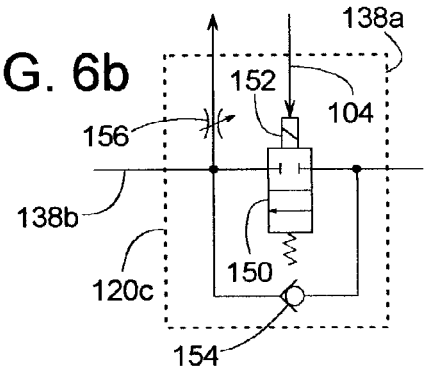
FIG. 6*b* is the same as FIG. 6*a*, but with the valve system in a speed-limiting position.

Referring to FIGS. 6*a* and 6*b*, valve system 120*c* is similar to system 120*b*; however, valve system 120*c* further includes a bypass check valve 154 and a fixed or adjustable flow restrictor 156. In FIG. 6*a*, valve system 120*c* is shown in its normal position, and in FIG. 6*b* is shown in its speed-limiting position. Signal 104 acts upon solenoid 152 to shift valve 150 between its normal and speed-limiting positions. In the normal position of FIG. 6*a*, valve 150 allows line 138*a* to feed pressurized air to line 138*b*. However, when force 28 increases to a predetermined limit, control 76 provides signal 104 such that signal 104 acts upon solenoid 152 to close valve 150. When valve 150 closes, as shown in FIG. 6*b*, it prevents pressurized air in line 138*a* from reaching line 138*b*. Also, flow restrictor 156 slowly bleeds air from line 138*b* to slowly reduce the pressure on diaphragm 118, which slowly reduces the speed of engine 32 and hoist drum 24. While the speed of the engine and hoist are slowly decreasing, check valve 154 enables an operator to force the hoist speed to decrease rapidly via manual actuator 114. For instance, if the operator moves actuator 114 to rapidly drop the pressure in line 138*a* to a level that is below the slowly decreasing pressure in line 138*b*, check valve 154 allows the air in line 138*b* to rush back into line 138*a* rather than slowing bleeding through flow restrictor 156. This feature can be useful when an operator needs to respond rapidly and drastically to a situation where the predetermined force limit is reached.

Figure 7A:
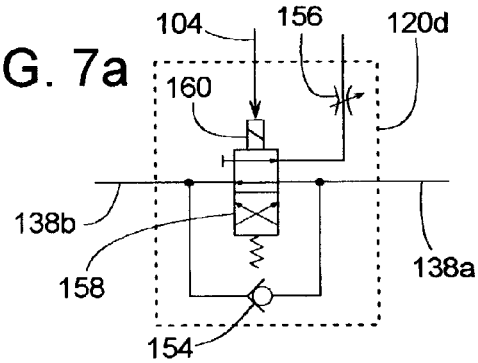
FIG. 7*a* is a schematic view of another valve system in a normal position.
Figure 7B:
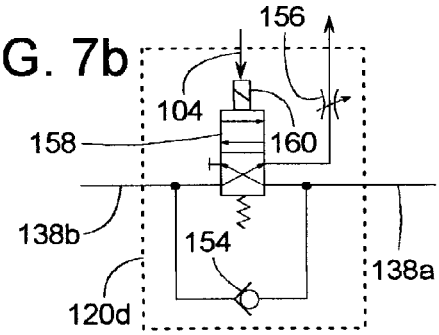
FIG. 7*b* is the same as FIG. 7*a*, but with the valve system in a speed-limiting position.

Referring to FIGS. 7*a* and 7*b*, valve system 120*d* is similar to system 120*c*; however, valve 150 is replaced by a four-way, two-position, solenoid-operated, springreturn valve 158. Valve 158 allows flow restrictor 156 to be installed at a location where the flow restrictor only bleeds air from line 138*b* when output 104 of control 76 commands valve system 120*d* to move from it normal position of FIG. 7*a* to its speedlimiting position of FIG. 7*b*. In the normal position of FIG. 7*a*, valve 158 allows line 138*a* to feed pressurized air to line 138*b* with no effect from check valve 154 and flow restrictor 156. However, when force 28 increases to a predetermined limit, control 76 provides signal 104 such that signal 104 acts upon a solenoid 160 to shift valve 158 as shown in FIG. 7*b*. In this position, valve 158 prevents pressurized air in line 138*a* from reaching line 138*b*. Also, flow restrictor 156 begins slowly bleeding air from line 138*b* to slowly reduce the pressure on diaphragm 118, which slowly reduces the speed of engine 32 and hoist drum 24. While the speed of the engine and hoist are slowly decreasing, check valve 154 still enables an operator to force the hoist speed to decrease rapidly via manual actuator 114.

Although the invention is described with reference to a preferred embodiment, it should be appreciated by those skilled in the art that various modifications are well within the scope of the invention. For example, in some cases, controller 76 can be provided with engine speed feedback signal 162 provided by an engine tachometer 164 or an engine-driven alternator/generator 166. Such engine speed feedback may be used in conjunction with the load signals to help modulate the speed of engine 32. It should also be noted that certain parts mentioned herein are provided by a company located at 1953 Mercer Road, Lexington, Ky., wherein the company's name is (or has been) Rexroth Corporation, Wabsco Fluid Power division of American-Standard, or Westinghouse Air Brake Company. Specific brand names and/or part numbers serve merely as examples and should not be used to limit the breath of the claims, as various other brands or parts well known to those skilled in the art could be used instead. Therefore, the scope of the invention is to be determined by reference to the claims that follow.

I claim:

1. A mobile service rig with a hoist for exerting an upward force that varies while servicing a well, comprising:

a truck frame;

a drive wheel coupled to the truck frame and being adapted to propel the mobile service rig;

a hoist drum supported by the truck frame;

a hoist derrick coupled to the truck frame;

a cable supported by the hoist derrick and wrapped around the hoist drum;

a block suspended from the cable for transmitting the upward force;

an engine supported by the truck frame;

a engine speed adjuster coupled to the engine for adjusting the speed thereof;

a transmission driven by the engine and selectively coupled to the hoist drum and the drive wheel;

a load sensor providing a load signal that varies in response to the upward force varying; and a controller having an input connected to receive the load signal and an output coupled to the engine speed adjuster, wherein the output commands the engine speed adjuster to limit the speed of the engine in response to the load signal reaching a predetermined limit.

2. The mobile service rig of claim 1, wherein the engine speed adjuster includes a pressure regulator that is manually actuated, a diaphragm operatively coupled to the engine to vary the speed thereof, a pneumatic line, and a valve system, wherein the pneumatic line places the pressure regulator, the diaphragm and the valve system in fluid communication with each other, the valve system responds to the output of the controller by moving from a normal position to a speed-limiting position in response to the load signal reaching the predetermined limit.

3. The mobile service rig of claim 2, wherein the valve system in the speed-limiting position releases air from the pneumatic line.

4. The mobile service rig of claim 1, wherein the output commands the engine speed adjuster to reduce the speed of the engine in response to the load signal reaching a predetermined limit.

5. The mobile service rig of claim 1, wherein the valve system includes a solenoid.

6. The mobile service rig of claim 1, further comprising a first hydraulic pad disposed below the hoist derrick, wherein an increase in the upward force causes a first hydraulic pressure within the first hydraulic pad to increase, wherein the load sensor includes a pressure transducer that responds to the first hydraulic pressure within the first hydraulic pad.

7. The mobile service rig of claim 6, further comprising a second hydraulic pad disposed below the hoist derrick, wherein the increase in the upward force causes a second hydraulic pressure within the second hydraulic pad to increase, wherein the pressure transducer responds to the second hydraulic pressure within the second hydraulic pad.

8. The mobile service rig of claim 7, wherein the controller provides a fault signal in response to the load signal decreasing to a predetermined level.

9. The mobile service rig of claim 1, wherein the load sensor is a strain gage.

10. The mobile service rig of claim 1, further comprising a torque converter that couples the engine to the transmission.

11. A mobile service rig subjected to a varying load, comprising:

a vehicle having a forward portion, a rear portion, and a drive wheel for propelling the vehicle;

a hoist derrick at the rear portion of the vehicle;

a hoist drum;

a hoist cable supported by the hoist derrick, wrapped around the hoist drum, and subjected to the varying load;

a load sensor that provides a load signal that varies in response to the varying load;

an engine disposed in the forward portion of the vehicle and coupled to the drive wheel and the hoist drum;

a first manual actuator disposed in the forward portion of the vehicle and coupled to the engine for varying the speed thereof when the engine is powering the drive wheel;

a second manual actuator disposed in the rear portion of the vehicle and coupled to the engine for varying the speed thereof when the engine is powering the hoist drum;

a pneumatic line extending from the second manual actuator to the forward portion of the vehicle to help couple the second manual actuator to the engine;

a valve system in fluid communication with the pneumatic line, wherein the valve system is movable between a normal position and a speed-limiting position; and a controller having an input connected to receive the load signal and an output coupled to the valve system, wherein the valve system moves from the normal position to the speed-limiting position to limit the speed of the engine in response to the load signal reaching a predetermined limit.

12. The mobile service rig of claim 11, wherein the valve system in the speed-limiting position releases air from the pneumatic line.

13. The mobile service rig of claim 11, wherein the valve system in the speed-limiting position releases air from the pneumatic line to reduce the speed of the engine in response to the load signal reaching the predetermined limit.

14. The mobile service rig of claim 11, wherein the valve system includes a solenoid.

15. The mobile service rig of claim 11, further comprising a first hydraulic pad supporting the hoist, wherein an increase in the varying load causes a first hydraulic pressure within the first hydraulic pad to increase, wherein the load sensor includes a pressure transducer that responds to the first hydraulic pressure within the first hydraulic pad.

16. The mobile service rig of claim 15, further comprising a second hydraulic pad supporting the hoist, wherein the increase in the varying load causes a second hydraulic pressure within the second hydraulic pad to increase, wherein the pressure transducer responds to the second hydraulic pressure within the second hydraulic pad.

17. The mobile service rig of claim 16, wherein the controller provides a fault signal in response to the load signal decreasing to a predetermined level.

18. The mobile service rig of claim 11, wherein the load sensor is a strain gage.

* * * * *